US007066730B2

(12) United States Patent
Macaluso

(10) Patent No.: US 7,066,730 B2
(45) Date of Patent: Jun. 27, 2006

(54) PIPELINE HEATER

(75) Inventor: Virgil Macaluso, Independence, KS (US)

(73) Assignee: Catalytic Industrial Group, Inc., Independence, KS (US)

( * ) Notice: Subject to any disclaimer, the term of this patent is extended or adjusted under 35 U.S.C. 154(b) by 0 days.

(21) Appl. No.: 10/990,256

(22) Filed: Nov. 16, 2004

(65) Prior Publication Data

US 2006/0105283 A1 May 18, 2006

(51) Int. Cl.
*F22B 15/00* (2006.01)

(52) U.S. Cl. ..... 432/225; 122/276

(58) Field of Classification Search ..... 122/235.13, 122/17.1, 4 D, 18.4, 1 B, 1 C, 355, 276; 432/225, 222, 226, 224, 232; 219/521
See application file for complete search history.

(56) References Cited

U.S. PATENT DOCUMENTS 3,262,494 A * 7/1966 Smith, Jr. ..... 165/104.31
5,073,108 A * 12/1991 Kirby ..... 432/225
5,174,751 A * 12/1992 Chapman et al. ..... 432/227
6,142,707 A * 11/2000 Bass et al. ..... 405/158

OTHER PUBLICATIONS

Statement regarding offer for sale of heaters depicted in accompanying drawings (Statement ( 1 page); Drawings (2 pages)).

* cited by examiner

*Primary Examiner*—Gregory Wilson
(74) *Attorney, Agent, or Firm*—Hovey Williams LLP

(57) ABSTRACT

A pipeline heater comprising a plurality of flameless catalytic IR emitters positioned about a section of pipe in a substantially diamond-shaped configuration, the diameter of the pipe section being greater than the diameters of the heater inlet and outlet manifolds in order to increase the residence time of the fluid within the heater. The pipeline heater may comprise a single or multiple passes of the pipe section therethrough, each pass having a plurality of catalytic emitters positioned thereabout in a substantially diamond-shaped configuration.

27 Claims, 5 Drawing Sheets

PIPELINE HEATER

BACKGROUND OF THE INVENTION

1. Field of the Invention

The present invention generally pertains to a pipeline heating apparatus and methods of heating gas and liquid streams using the same. The inventive pipeline heaters employ flameless, catalytic IR emitters positioned about a section of pipe which is in the form of a volume bottle for increasing the residence time of the fluid in the heater.

2. Description of the Prior Art

Pipeline heaters are used to heat gas and liquids flowing through a pipeline in order to prevent regulators and various sensing equipment from freezing up during pipeline operation. Traditionally, water bath indirect heaters have been used for this purpose. In water bath heaters, a vessel is filed with water or a mixture of water and ethylene glycol. A fire tube and process coil are submerged in the bath which transfers heat from the fire tube to the process stream in the coil. These types of heaters have the drawback in that the fire tubes produce significant amounts of noise and ethylene glycol presents health risks to people, pets, and property. In addition, water bath heaters tend to be less efficient because the heat transfer occurs through an intermediate medium, namely the water bath.

Because of the undesirable attributes of conventional water bath heaters, there is a true need for quiet and efficient apparatus and methods for heating pipeline fluids such as natural gas and other hydrocarbon streams. Furthermore, there is a particular need for an environmentally friendly pipeline heater system that generates virtually no nitrous oxide or volatile organic compounds.

SUMMARY OF THE INVENTION

The present invention generally pertains to a pipeline heater and a method of heating a fluid stream therewith. As used herein, the term "fluid" refers to compositions in either a liquid or gaseous state. The inventive pipeline heater generally comprises an inlet manifold presenting a diameter $D_1$, a pipe section presenting a diameter $D_2$, a plurality of flameless catalytic IR emitters positioned about the pipe section in a substantially diamond-shaped configuration, and an outlet manifold presenting a diameter $D_3$. As used herein, the term "substantially diamond-shaped configuration" refers to the cross-sectional configuration of the catalytic emitter array taken along the plane that perpendicularly intersects the direction of fluid flow in the pipe. In preferred embodiments, the emitters are arranged at an approximately 90° incline relative to the emitters adjacent thereto and are in a surrounding relationship to the pipe carrying the fluid to be heated. It has been discovered that by positioning the catalytic emitters in such a manner that the quantity of heat transferred to the pipe (and ultimately to the fluid) can be significantly increased. Consequently, this arrangement is capable of heating the fluid stream to a temperature that is at least about 100° F. greater than a similarly sized, conventional heater.

In another aspect, the inventive pipeline heater comprises an inlet manifold presenting a diameter $D_1$, a pipe section presenting a diameter $D_2$, a plurality of flameless catalytic IR emitters positioned about the pipe section, and an outlet manifold presenting a diameter $D_3$, with $D_2$ being greater than each of $D_1$ and $D_3$. Unless otherwise specified, the term "diameter" as used herein in relation to the manifolds and pipe section refer to the inner diameter of the structures through which the fluid stream flows. Preferably, $D_2$ is at least 50% greater, more preferably at least about 100% greater, even more preferably at least about 200% greater, and most preferably at least about 400% greater than each of $D_1$ and $D_3$. In this manner, the pipe section forms a "volume bottle" which serves to slow the fluid flow rate through the heater thereby increasing the residence time of the fluid in the heater and allowing for greater heat transfer to occur. For example, in the instance where $D_1$ is about 2 inches, $D_2$ can be up to about 8 inches, or when $D_1$ is about 4 inches, $D_2$ can be about 10 inches.

The pipes section used to conduct the pipeline fluid through the heater can be a relatively straight section thereby making a single pass through the heater, or the pipe section can be serpentine thereby making multiple passes through the heater. In the case of multiple passes, each pass has a plurality of flameless catalytic IR emitters positioned thereabout, and preferably in a substantially diamond-shaped configuration. Because the catalytic emitters do not produce a flame, the heaters operate much more quietly than conventional water bath-type heaters and can be safely used in virtually any location. Also, the use of automation equipment allows for remote operation of the heater.

Pipeline heaters according to the present invention are generally environmentally safe and nuisance free. The pipeline heaters produce virtually no nitrous oxide or volatile organic compounds during operation thereof. Because there are no fluids, stacks, or containment rings, the pipeline heaters present few rust corrosion issues and present no chemical odor problems.

Methods of using the inventive heaters are also provided herewith and generally comprise providing a heater such as those described above and passing a fluid stream therethrough for heating of the stream.

DETAILED DESCRIPTION OF THE PREFERRED EMBODIMENT

The following examples set forth preferred pipeline heaters in accordance with the present invention. It is to be understood, however, that these examples are provided by way of illustration and nothing therein should be taken as a limitation upon the overall scope of the invention.

Figure 2:
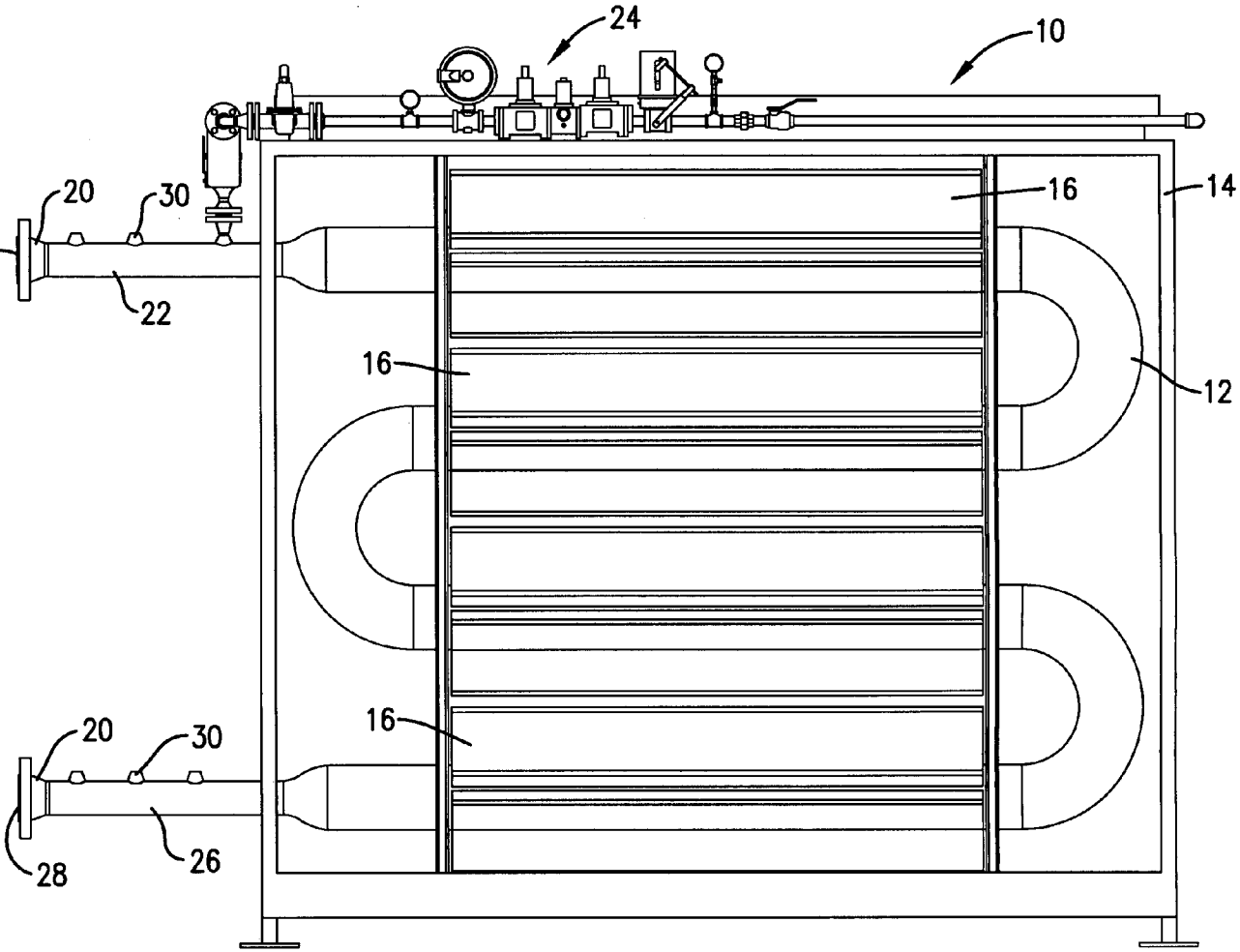
FIG. 2 is a side view depicting the volume bottle arrangement of the heater of FIG. 1.
Figure 1:
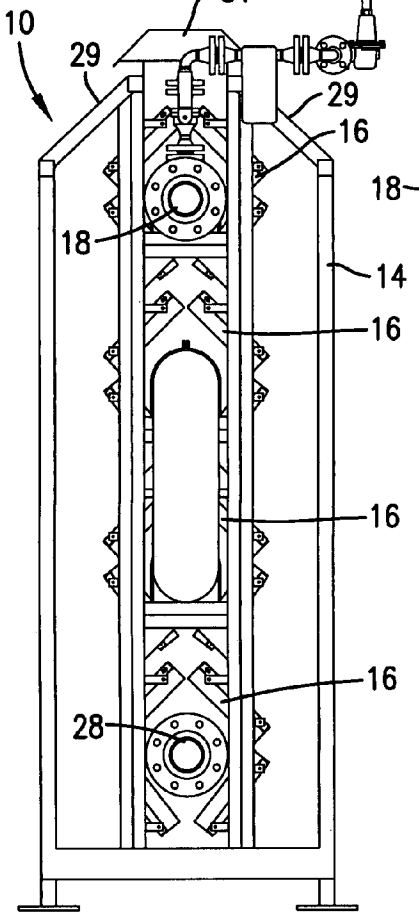
FIG. 1 is an end profile view of a multiple-pass heater according to the present invention.

Turning now to the drawings, and in particular FIGS. 1 and 2 which depict a four-pass pipeline heater 10, heater 10 generally comprises a serpentine pipe 12 located within a heater housing 14. Each pass of coil 12 is surrounded by a plurality of catalytic IR emitters 16 arranged in a diamond-shaped pattern. Emitters 16 are generally flameless, gas-fired elements that provide heat in the form of infrared energy.

Exemplary emitters include those described in U.S. Pat. Nos. 5,557,858 and 6,003,244, both of which are incorporated by reference herein. Such catalytic emitters are also available from Catalytic Industrial Group, Inc. of Independence, Kans.

The diamond-shaped emitter arrangement allows more of the infrared energy to be concentrated over the entire circumference of the serpentine pipe 12. This arrangement provides substantially increased pipe temperatures and improves efficiency by directing more of the infrared energy toward pipe 12.

In operation, the fluid to be heated enters heater 10 through inlet 18. Heater 10 can be placed directly in-line with the pipeline system and is coupled thereto by flanges 20. The fluid flows through an inlet manifold 22 to which a sensing and regulating equipment 24 that monitor various properties of the inlet fluid may be attached. In the embodiment shown in FIG. 2, inlet manifold 22 extends just inside housing 14 where it is coupled with serpentine pipe 12. It is apparent that the diameter of pipe 12 is substantially greater than the diameter of manifold 22. By employing a larger diameter, pipe 12 provides a greater surface area for heat transfer to occur and slows the fluid flow through heater 10 thereby maximizing fluid retention time.

After the last pass of pipe 12, the heated fluid flows through exit manifold 26 and is returned to the pipeline system at outlet 28. The diameter of exit manifold 26 is also less than the diameter of pipe 12, and preferably is approximately the same as inlet manifold 22. Manifold 26 also is provided with a number of ports 30 to which sensing equipment capable of monitoring properties of the heated fluid stream can be attached.

A venting hood 31 is provided proximate the top portion of housing 14 thereby permitting the escape of exhaust gases from catalytic emitters 16. The top portion of housing 14 comprises a pair of upwardly converging sidewall sections 29 which direct the exhaust gases toward hood 31. Side panels (not shown) can be placed around the outer periphery of housing 14 to further insulate heater 10. Slats may be provided in the side panels to provide additional ventilation.

Heater 10 is capable of being made fully automated thereby allowing for remote start, stop, and temperature control. For example, the operation of heater 10 can be automatically adjusted to achieve a desired fluid exit temperature by sensing the input temperature of the fluid in manifold 22 and controlling the output of emitters 16. This automatic operation allows heater 10 to be placed in locations that are removed from populated areas without requiring an on-site human presence. Monitoring of the heater performance can occur at a more centralized and convenient location.

Heater 10 can be modified to operate without a conventional electrical energy source. This modification is particularly useful in remote locations or in locations that are prone to power interruptions. During start up of the heater, a portable generator is used to preheat the catalyst. Operation of the heater is spontaneous from that point forward. A thermostat is then used to control the operating temperature by adjusting the fuel-gas flow rate between a preset minimum and maximum.

Figure 3:
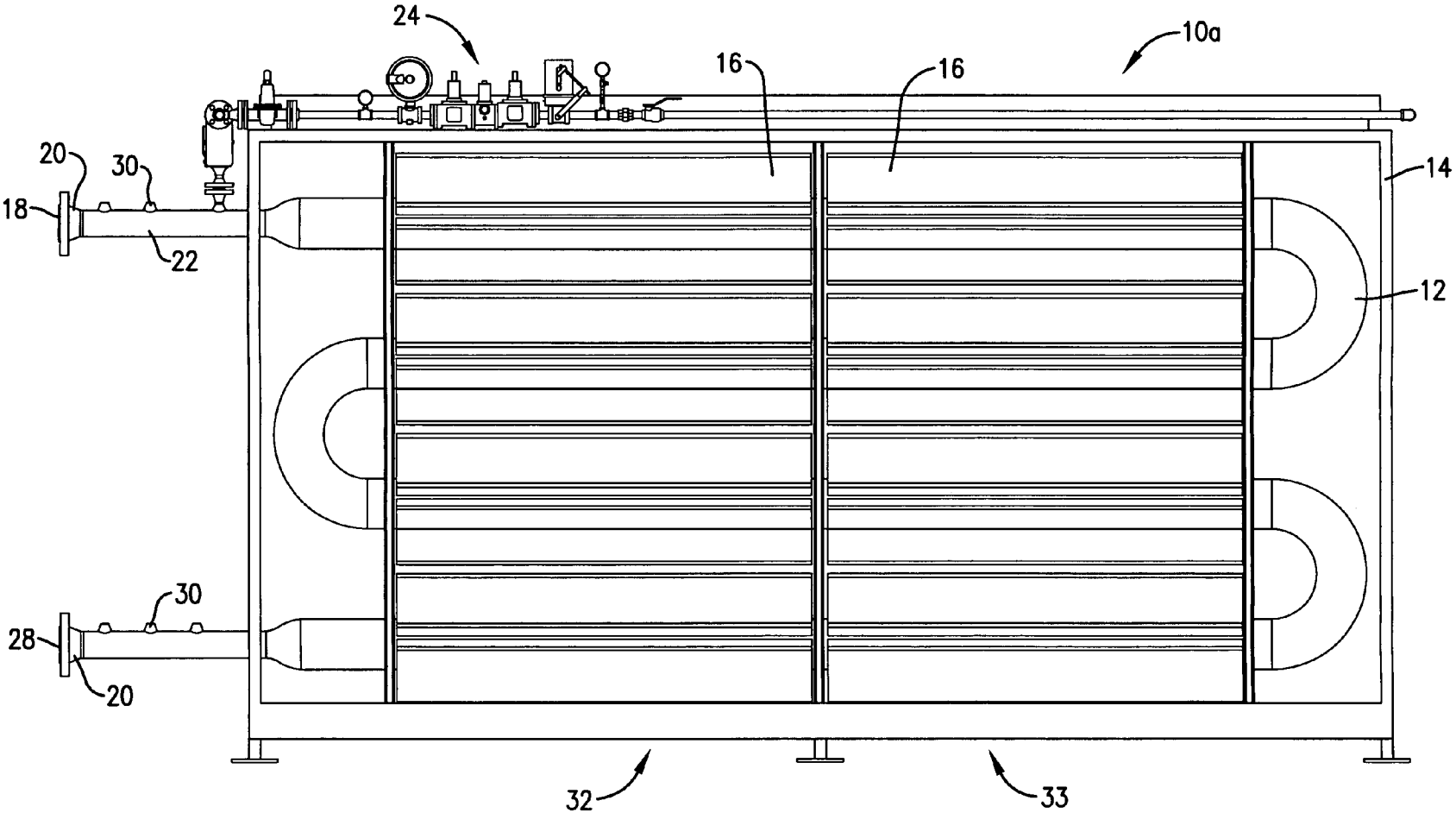
FIG. 3 is a side view of a modified version of the heater shown in FIG. 2 with two banks of heating elements.

FIG. 3 depicts a pipeline heater 10*a* that is similar to heater 10 shown in FIG. 2, however, heater 10*a* is an elongated version thereof and comprises two banks of catalytic emitters 32, 33. This elongated heater 10*a* provides increased residence time for the fluid passing therethrough and is suitable for use in applications where greater heat transfer is required. In all other aspects, heater 10*a* is identical to heater 10 of FIG. 2.

Figure 5:
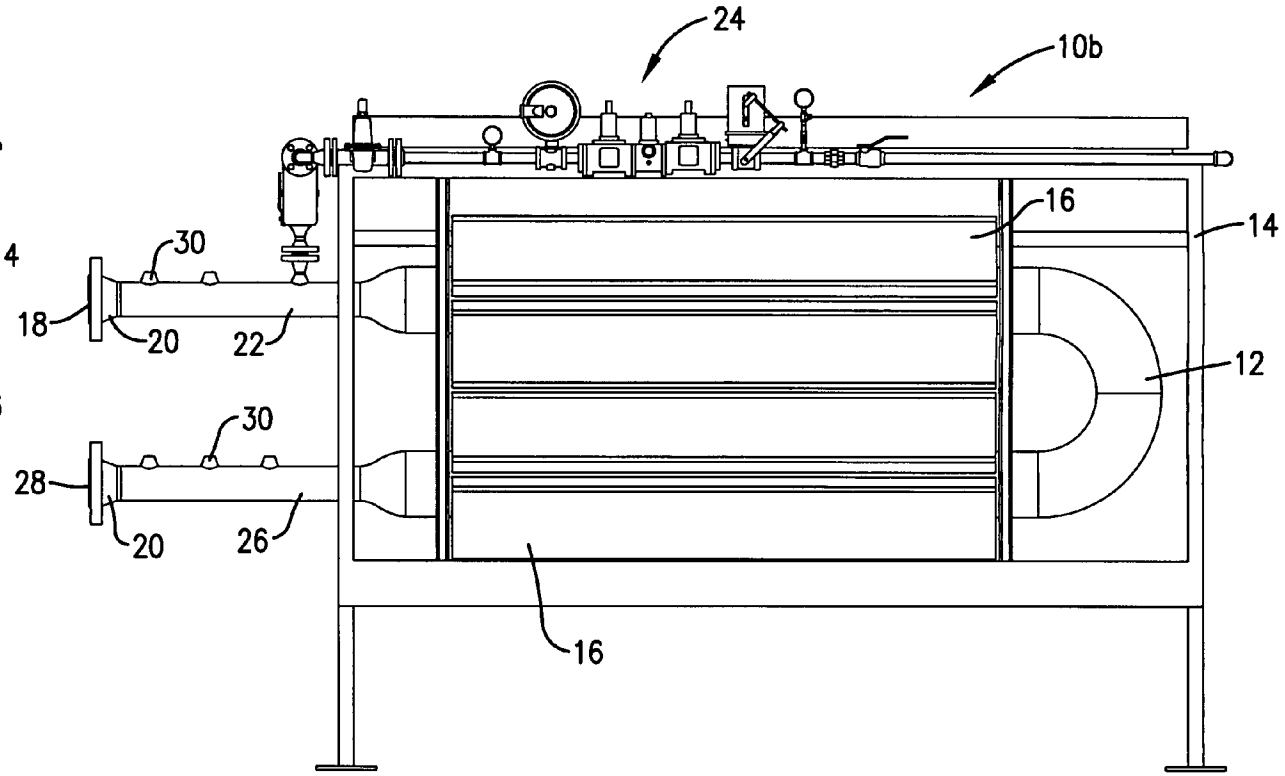
FIG. 5 is a side view of the heater of FIG. 4.
Figure 4:
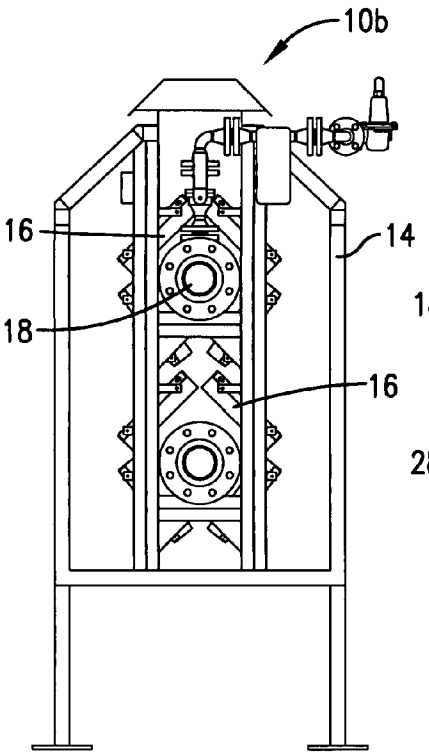
FIG. 4 is an end profile view of a two-pass heater according to the present invention.

Turning now to FIGS. 4 and 5, these figures depict an alternate embodiment 10*b* of the inventive pipeline heater. As heater 10*b* shares many of the same parts as heater 10 shown in FIGS. 1 and 2, the same reference numerals will be used throughout. Heater 10*b* is a two-pass heater and is suitable for use in applications that do not require as significant heat transfer as heater 10 provides. The fluid stream to be heated enters heater 10*b* through inlet 18 which is secured to the pipeline system with flange 20. The fluid stream continues along through inlet manifold 22 which has approximately the same diameter as the pipeline conduit. Once inside the housing 14 the manifold 22 is necked up into serpentine pipe 12 thereby decreasing the fluid stream flow rate and increasing the residence time of the fluid within heater 10*b*. The catalytic emitters 16 are arranged in a diamond-shaped pattern. The emitter arrangement generally comprises two pairs of emitters, each emitter pair comprising two parallel emitters 16 positioned facing each other on opposite sides of pipe 12. The emitters 16 are positioned in a surrounding relationship to each pass of pipe 12 so that substantially the entire circumference of pipe 12 is exposed to the infrared energy from emitters 16. After the second pass, pipe 12 containing the heated fluid stream is necked down and the fluid stream passes into exit manifold 26 and reenters the pipeline system at outlet 28.

Figure 6:
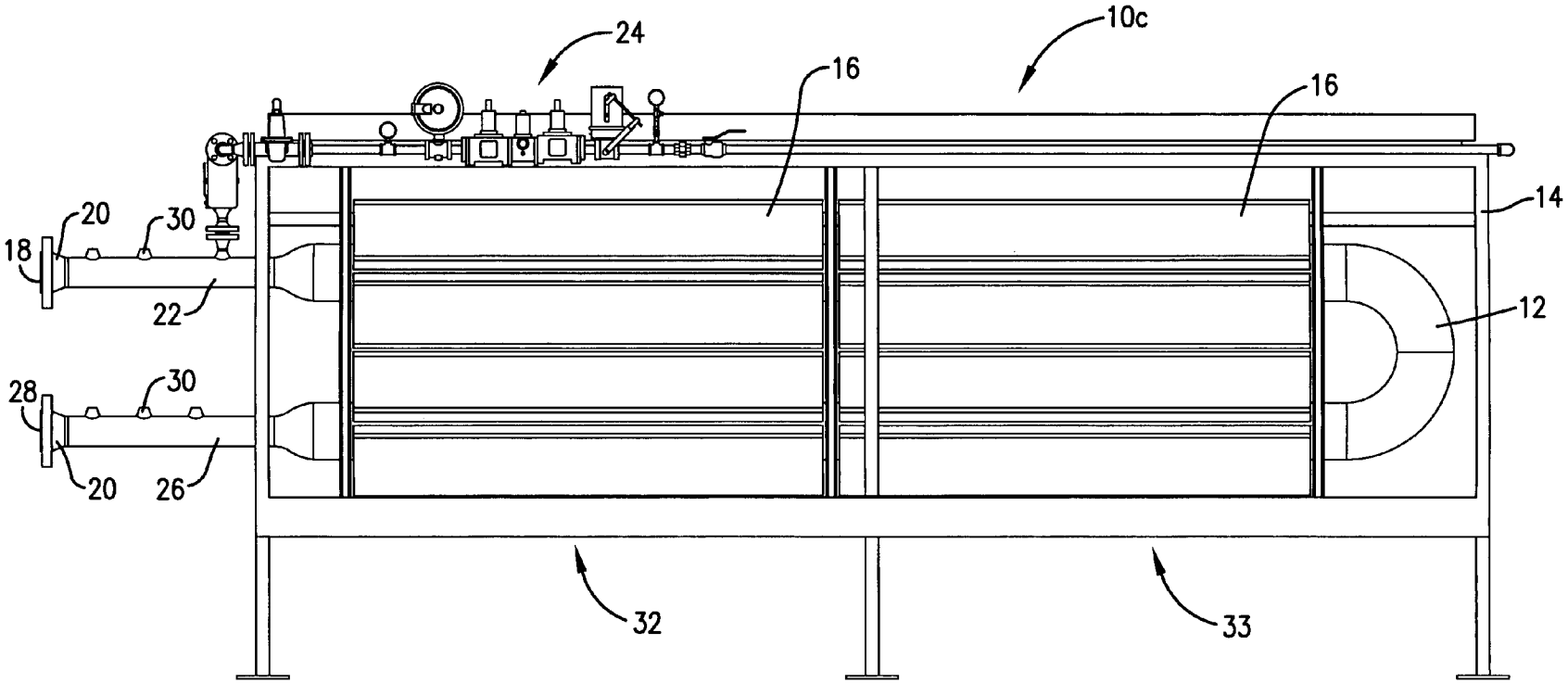
FIG. 6 is a side view of a modified version of the heater shown in FIG. 5 with two banks of heating elements.
Figure 7:
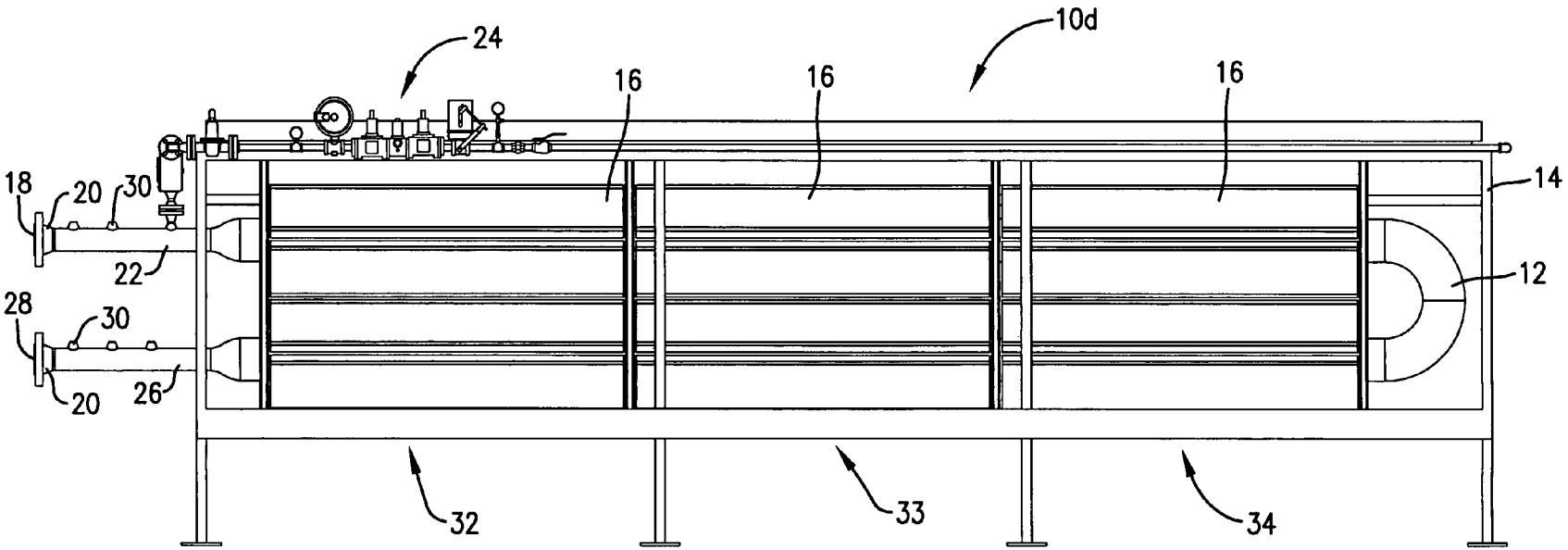
FIG. 7 depicts a further modification to the heater of FIG. 5 showing three banks of heating elements.

FIGS. 6 and 7 depict yet additional embodiments derived from the embodiment shown in FIGS. 4 and 5. FIG. 6 shows an elongated two-pass heater 10*c* comprising two emitter banks 32, 33. FIG. 7 is substantially identical to FIG. 6 but includes an additional emitter bank 34. It is clear that additional modifications to this design are possible in order to meet the needs of a particular application. For instance, if overhead clearance is an issue, a less tall but longer heater (i.e., 10*d* of FIG. 7) can be used instead of the four-pass heater 10 shown in FIG. 2. Heater 10*d* can be designed to achieve the same residence time and heat transfer as a four-pass heater 10. Along the same lines, additional emitter banks may be added to any of the embodiments shown in order to achieve greater residence times and consequently effect a greater heat transfer to the fluid stream passing therethrough. It is also possible for the pipe 12 to comprise one or a plurality of passes through heater 10 depending upon a particular application.

Preferably, pipe 12 has a dark finish in order to facilitate the maximum absorption of infrared energy from emitters 16. Conversely, housing 14 and many of the other components comprising heater 10 comprise a lighter, reflective finish in order to retain as much infrared energy within heater 10 as possible. Insulation may also be added to heater 10 to assist in this goal and increase the overall efficiency of heater 10. Preferably, housing 14, in large part, is made from stainless steel.

The inventive heaters 10 can be used in many different applications where cold operating conditions exist. The heaters are particularly useful in heating natural gas streams, but may also be used to heat high pressure gas from wellheads and distribution stations, natural gas at gate stations, and high pressure gas from oil fields. The heaters can also be used to heat liquid streams such as light hydrocarbons, viscous oils, and water or various aqueous streams in order to reduce pump pressures and improve pumping efficiencies.

I claim:

1. A pipeline heater comprising:

an inlet manifold presenting a diameter $D_1$;

a pipe section fluidly coupled with said inlet manifold and presenting a diameter $D_2$;

a plurality of flameless catalytic IR emitters positioned about said pipe section in a substantially diamond-shaped configuration; and an outlet manifold fluidly coupled with said pipe section and presenting a diameter $D_3$, $D_2$ being greater than each of $D_1$ and $D_3$, said pipe section and said emitters being fixedly secured within a housing.

2. The heater of claim 1, $D_1$ and $D_3$ being approximately equal.

3. The heater of claim 2, $D_2$ being at least about 50% greater than each of $D_1$ and $D_3$.

4. The heater of claim 1, said pipe section being located entirely within said housing.

5. The heater of claim 1, at least a portion of said inlet and outlet manifolds being located within said housing.

6. The heater of claim 1, said housing being constructed of a reflective material.

7. The heater of claim 6, at least a portion of said housing being formed of stainless steel.

8. The heater of claim 1, said housing comprising a venting hood for venting of exhaust gases produced by said catalytic emitters from said housing.

9. The heater of claim 1, said heater comprising a plurality of pipe sections, each of said pipe sections having a plurality of flameless catalytic IR emitters positioned thereabout in a substantially diamond-shaped configuration.

10. A pipeline heater comprising:

an inlet manifold presenting a diameter $D_1$;

a pipe section fluidly coupled with said inlet manifold and presenting a diameter $D_2$;

a plurality of flameless catalytic IR emitters positioned about said pipe section; and an outlet manifold fluidly coupled with said pipe section and presenting a diameter $D_3$, $D_2$ being greater than each of $D_1$ and $D_3$, said pipe section and said emitters being fixedly secured within a housing.

11. The heater of claim 10, $D_1$ and $D_3$ being approximately equal.

12. The heater of claim 11, $D_2$ being at least about 50% greater than each of $D_1$ and $D_3$.

13. The heater of claim 10, said pipe section being located entirely within said housing.

14. The heater of claim 10, at least a portion of said inlet and outlet manifolds being located within said housing.

15. The heater of claim 10, said housing being constructed of a reflective material.

16. The heater of claim 15, at least a portion of said housing being formed of stainless steel.

17. The heater of claim 10, said housing comprising a venting hood for venting of exhaust gases produced by said catalytic emitters from said housing.

18. The heater of claim 10, said heater comprising a plurality of pipe sections, each of said pipe sections having a plurality of flameless catalytic IR emitters positioned thereabout in a substantially diamond-shaped configuration.

19. A method of heating a fluid stream comprising the steps of:

providing a heater including— an inlet manifold presenting a diameter $D_1$;

a pipe section presenting a diameter $D_2$;

a plurality of flameless catalytic IR emitters positioned about said pipe section in a substantially diamond-shaped configuration; and an outlet manifold presenting a diameter $D_3$; and passing said stream through said heater.

20. The method of claim 19, said heater comprising a plurality of pipe sections, each of said pipe sections having a plurality of flameless catalytic IR emitters positioned thereabout in a substantially diamond-shaped configuration.

21. The method of claim 19, $D_2$ being greater than each of $D_1$ and $D_3$.

22. The method of claim 19, $D_1$ and $D_3$ being approximately equal.

23. The method of claim 22, $D_2$ being at least about 50% greater than each of $D_1$ and $D_3$.

24. A method of heating a fluid stream comprising the steps of:

providing a heater including— an inlet manifold presenting a diameter $D_1$;

a pipe section presenting a diameter $D_2$;

a plurality of flameless catalytic IR emitters positioned about said pipe section; and an outlet manifold presenting a diameter $D_3$, $D_2$ being greater than each of $D_1$ and $D_3$; and passing said stream through said heater.

25. The method of claim 24, said heater comprising a plurality of pipe sections, each of said pipe sections having a plurality of flameless catalytic IR emitters positioned thereabout in a substantially diamond-shaped configuration.

26. The method of claim 24, $D_1$ and $D_3$ being approximately equal.

27. The method of claim 26, $D_2$ being at least about 50% greater than each of $D_1$ and $D_3$.

* * * * *